US006575397B1

(12) United States Patent
Tramontina et al.

(10) Patent No.: US 6,575,397 B1
(45) Date of Patent: Jun. 10, 2003

(54) DISPENSER FOR SHEET MATERIAL

(75) Inventors: Paul Francis Tramontina, Alpharetta, GA (US); Richard Paul Lewis, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/132,435

(22) Filed: Apr. 25, 2002

(51) Int. Cl.[7] ..... B65H 18/02

(52) U.S. Cl. ..... 242/593; 242/615.3; 242/615.4; 242/132; 242/137; 206/409; 220/253

(58) Field of Search ..... 242/593, 132, 242/137, 146, 615.3, 615.4; 206/409, 390, 394, 205, 210, 812; 220/253; 221/63

(56) References Cited

U.S. PATENT DOCUMENTS

| | | | | |
|---|---|---|---|---|
| 3,523,653 | A | | 8/1970 | Hansen |
| 3,627,216 | A | | 12/1971 | Ekuan |
| 3,923,223 | A | | 12/1975 | Larsson et al. |
| 4,180,160 | A | | 12/1979 | Ogawa et al. |
| 4,262,816 | A | | 4/1981 | Margulies |
| 4,289,262 | A | | 9/1981 | Finkelstein |
| 4,460,106 | A | | 7/1984 | Moulding, Jr. et al. |
| 4,524,895 | A | * | 6/1985 | Lunden |
| 4,534,491 | A | | 8/1985 | Norton et al. |
| 4,579,266 | A | | 4/1986 | Bünger et al. |
| D285,995 | S | | 10/1986 | Minost |
| D296,765 | S | | 7/1988 | Urion |
| 4,756,460 | A | | 7/1988 | Ornros |
| 4,760,970 | A | | 8/1988 | Larsson et al. |

(List continued on next page.)

FOREIGN PATENT DOCUMENTS

| | | |
|---|---|---|
| DE | 2222357 | 5/1972 |
| DE | 2818757 | 11/1979 |
| EP | 0107487 | 5/1984 |
| EP | 0117567 | 9/1984 |
| EP | 0128127 | 12/1984 |
| EP | 0091411 | 12/1985 |
| EP | 0061248 | 11/1986 |

OTHER PUBLICATIONS

Abstract for EP 550863, Jul. 14, 1993, Loctite Deut GmBH.
Abstract for DE 2222357, May 6, 1972, Molnlycke GmbH.
Abstract for DE 2818757, Nov. 8, 1979, Daimler–Benz AG.
Abstract for FR 2667853, Apr. 17, 1992, Granger M.
Abstract for FR 2667854, Apr. 17, 1992, Granger M.
Abstract for FR 2668694, May 7, 1992, Granger M.
Abstract for FR 2669818, Jun. 5, 1992, Granger M.
American Society for Testing Materials (ASTM) Designation: D 3776–96, "Standard Test Methods for Mass Per Unit Area (Weight) of Fabric," pp. 86–89, published Jun. 1996.
American Society for Testing Materials (ASTM) Designation: D 5035–95, "Standard Test Method For Breaking Force and Elongation of Textile Fabrics (Strip Method)," pp. 682–688, published Jul. 1995.
TAPPI Official Test Method T 411 om–89, "Thickness (Caliper) of Paper, Paperboard, and Combined Board," published by the TAPPI Press, Atlanta, Georgia, revised 1989, pp. 1–3.

*Primary Examiner*—William A. Rivera
(74) *Attorney, Agent, or Firm*—Sue C. Watson, Esq.

(57) ABSTRACT

A dispenser for dispensing sheet material includes a housing having a chamber configured to hold sheet material and an access door configured to provide both access to the chamber and closure to the chamber. The housing includes a dispensing member supported by the access door. The dispensing member has a first panel and a second panel. At least one panel moves so that the opening in the first panel and the exit port in the second panel align to permit sheet material to be threaded therethrough for loading, and at least one panel moves so that the opening and exit port are moved out of alignment for dispensing the sheet material. A method of installing sheet material in a dispenser.

35 Claims, 11 Drawing Sheets

U.S. PATENT DOCUMENTS

| | | | | | |
|---|---|---|---|---|---|
| 4,846,415 | A | | 7/1989 | Jernberg et al. | |
| 4,905,868 | A | | 3/1990 | Beane et al. | |
| 4,979,617 | A | | 12/1990 | Benoit | |
| 5,065,924 | A | | 11/1991 | Granger | |
| 5,131,561 | A | | 7/1992 | Casperson et al. | |
| 5,141,171 | A | | 8/1992 | Yang | |
| 5,205,455 | A | | 4/1993 | Moody | |
| 5,211,308 | A | | 5/1993 | Decker et al. | |
| 5,215,211 | A | | 6/1993 | Eberle | |
| 5,219,126 | A | | 6/1993 | Schutz | |
| D337,464 | S | | 7/1993 | Giugiaro | |
| D339,014 | S | | 9/1993 | Giugiaro | |
| D339,015 | S | | 9/1993 | Giugiaro | |
| 5,246,137 | A | | 9/1993 | Schutz et al. | |
| 5,263,607 | A | | 11/1993 | Temesvary et al. | |
| 5,273,184 | A | | 12/1993 | Rizzuto | |
| 5,310,083 | A | | 5/1994 | Rizzuto | |
| 5,346,064 | A | | 9/1994 | Rizzuto | |
| 5,370,338 | A | * | 12/1994 | Lewis | 206/409 |
| 5,480,060 | A | | 1/1996 | Blythe | |
| 5,560,514 | A | | 10/1996 | Frazier | |
| 5,577,634 | A | * | 11/1996 | Morand | 221/63 |
| 5,577,635 | A | | 11/1996 | Block | |
| 5,582,362 | A | | 12/1996 | Johnson et al. | |
| D385,734 | S | | 11/1997 | Mervar et al. | |
| 5,715,971 | A | * | 2/1998 | Morand | 242/593 |
| 5,749,492 | A | | 5/1998 | Petterson | |
| 5,762,286 | A | * | 6/1998 | Schutz | 242/593 |
| 5,762,287 | A | | 6/1998 | Schutz | |
| 5,765,718 | A | * | 6/1998 | Grasso et al. | 242/615.3 |
| 5,769,354 | A | | 6/1998 | Lindh et al. | |
| D396,369 | S | | 7/1998 | Giugiaro | |
| 5,785,274 | A | | 7/1998 | Johnson | |
| D403,543 | S | | 1/1999 | Grasso et al. | |
| 5,857,642 | A | | 1/1999 | Zinnbauer | |
| 5,868,346 | A | | 2/1999 | Cobos | |
| 6,062,422 | A | | 5/2000 | Ellis | |
| 6,082,663 | A | | 7/2000 | Tramontina et al. | |
| 6,089,499 | A | | 7/2000 | Robinson | |
| 6,129,240 | A | | 10/2000 | Morand | |
| 6,145,782 | A | * | 11/2000 | King et al. | 242/593 |
| 6,182,858 | B1 | | 2/2001 | Hartog | |
| 6,189,726 | B1 | | 2/2001 | Fick | |
| 6,267,321 | B1 | * | 7/2001 | Tramontina | 206/409 |
| D449,474 | S | | 10/2001 | Conran et al. | |
| 6,328,252 | B1 | * | 12/2001 | Neveu et al. | 242/615.3 |

FOREIGN PATENT DOCUMENTS

| | | | |
|---|---|---|---|
| EP | 0068722 | | 4/1988 |
| EP | 0238460 | | 8/1990 |
| EP | 0231183 | | 1/1991 |
| EP | 0550863 | | 7/1993 |
| EP | 0480848 | | 1/1994 |
| EP | 0740921 | A | 11/1996 |
| EP | 0642317 | | 2/1997 |
| EP | 0595779 | | 4/2000 |
| EP | 1066787 | A1 | 1/2001 |
| FR | 2667853 | | 4/1992 |
| FR | 2667854 | | 4/1992 |
| FR | 2668694 | | 5/1992 |
| FR | 2669818 | | 6/1992 |
| GB | 1455216 | | 11/1976 |
| GB | 2038778 | | 7/1980 |
| GB | 2063213 | | 6/1981 |
| GB | 2120639 | | 12/1983 |
| GB | 2145693 | | 9/1986 |
| GB | 2270299 | | 3/1994 |
| WO | 93/22963 | | 11/1993 |
| WO | 93/22964 | | 11/1993 |
| WO | 97/21377 | | 6/1997 |

* cited by examiner

DISPENSER FOR SHEET MATERIAL

FIELD OF THE INVENTION

The invention generally relates to dispensers, and more specifically, to dispensers for dispensing sheet material.

BACKGROUND

Dispensers for rolls or stacks of sheet material have an exit port which desirably permits one sheet material at a time to be dispensed from the dispenser. Such dispensers, however, can be difficult or complicated to load and/or adjust for dispensing. In addition, it can be difficult for an operator to thread newly loaded sheet material through small or difficult to access openings and/or exit ports in the dispenser. If such a dispenser is improperly loaded, adjusted, or threaded, excessive or inadequate dispensing of sheet material occurs.

It would be advantageous to have a dispenser for sheet material which is rolled, or sheet material that is stacked, which permits an operator to quickly and easily load sheet material therein. Such a dispenser would provide features permitting easy adjustment and threading to facilitate proper dispensing of the sheet material.

DEFINITIONS

As used herein, the term "caliper" refers to the thickness measurement of a sheet taken under constant force. The caliper may be determined using test method number TAPPI 411-OM-89.

As used herein, the term "basis weight" (hereinafter "BW") is the weight per unit area of a sample and may be reported as gram-force per meter squared and may be hereinafter calculated using test procedure ASTM D3776-96.

As used herein, the term "machine direction" (hereinafter "MD") is the direction of a material parallel to its forward direction during processing.

As used herein, the term "machine direction tensile" (hereinafter MDT) is the breaking force in the machine direction required to rupture a specimen. The results may be reported as gram-force and abbreviated as "gf". The MDT may be determined using test method number ASTM D5035-95.

As used herein, the term "tab strength" is the breaking force in the machine direction required to rupture a sheet product along its perforations. The results may be reported as gram-force and abbreviated as "gf".

As used herein, the term "exit port" is the opening provided in a dispenser or an opening in an apparatus positioned adjacent an opening in a dispenser for the passage of sheet material out of the dispenser.

As used herein, the term "centerflow roll" or "centerflow roll product" means sheet material wound cylindrically about a center, but permitting the removal of material from the center, such as the roll product described in, for example, WO 97/21377.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, paper towels, label rolls, or other fibrous, films, textiles, or filamentary products.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "couple" includes, but is not limited to, joining, connecting, fastening, linking, or associating two things integrally or interstitially together.

SUMMARY OF THE INVENTION

In one aspect of the invention, a dispenser for dispensing sheet material is provided. The dispenser includes a housing having a chamber configured to hold sheet material. The housing also includes an access door configured to provide both access to the chamber and closure to the chamber. The dispenser also includes a dispensing member supported by the access door. The dispensing member has a first panel having an opening therein which is spaced-apart from a second panel having an exit port provided therein. At least one panel is movable such that when the access door is positioned in an opened loading position to permit sheet material to be loaded into the chamber, at least one of the panels moves so that a portion of the opening in the first panel and a portion of the exit port in the second panel are moved into an axial alignment to permit sheet material to be readily threaded therethrough. When the access door is positioned in a closed dispensing position, at least one of the panels moves so that the opening in the first panel and the exit port in the second panel are moved out of axial alignment so that the sheet material in the chamber flows through the non-aligned opening and exit port.

In another aspect of the invention, an apparatus for use with a dispenser housing is provided. The apparatus is used with a dispenser housing having a chamber configured to hold sheet material. The dispenser housing also has an access door configured to provide both access to the chamber and closure to the chamber. The apparatus is configured to cooperate with the access door to provide dispensing of sheet material therethrough. The apparatus includes a dispensing member configured to be supported adjacent the access door. The dispensing member includes a first panel having an opening therein which is spaced-apart from a second panel having an exit port provided therein. At least one panel is moveable such that when the access door is positioned in an opened loading position to permit sheet material to be loaded into the chamber, at least one of the panels moves so that a portion of the opening in the first panel and a portion of the exit port in the second panel are moved into an axial alignment to permit sheet material to be readily threaded therethrough. When the access door is positioned in a closed, dispensing position, at least one of the panels moves so that the opening in the first panel and the exit port in the second panel are moved out of axial alignment so that the sheet material in the chamber flows through the non-aligned opening and exit port.

In yet another aspect of the invention, a method of installing sheet material in a dispenser is provided. A dispenser having a housing including a chamber configured to hold sheet material is provided. The housing includes an access door and a dispensing member supported by the access door. The dispensing member includes a moveable first panel having an opening therein which is spaced-apart from a second panel having an exit port provided therein. The opening in the movable first panel is aligned with the exit port in the second panel by opening the access door, the first panel being moved so that at least a portion of the opening therein is in axial alignment with at least a portion of the exit port. Sheet material is then disposed into the chamber of the housing. A leading edge of the sheet material is threaded through the axially aligned opening and exit port such that the sheet material extends a distance therefrom. The opening in the first panel and the exit port are moved out of axial alignment by closing the access door, the first panel being moved so that the opening therein and the exit port are not aligned. The sheet material in the chamber flows through the non-aligned opening and exit port.

DETAILED DESCRIPTION

Figure 1:
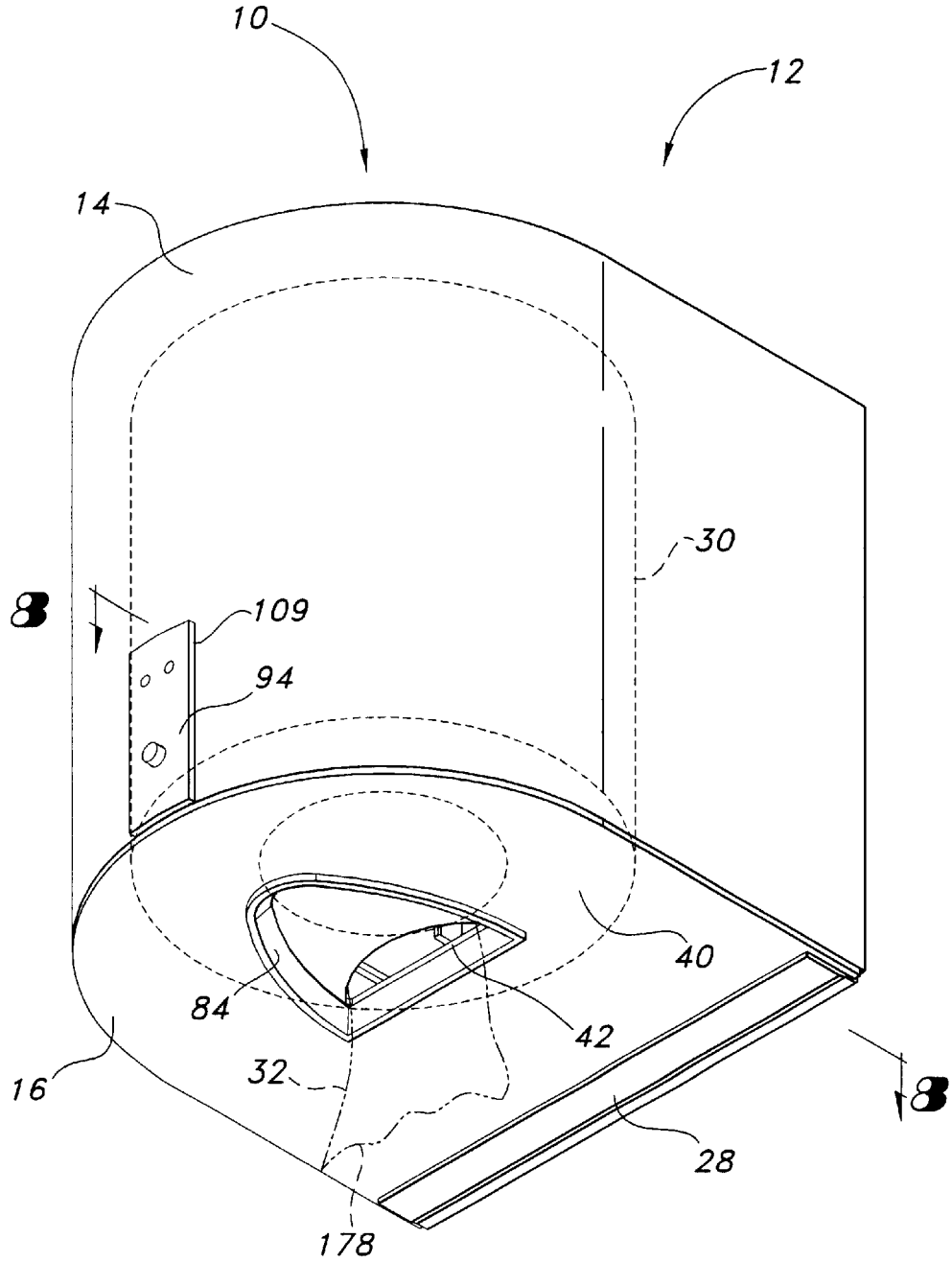
FIG. 1 is a perspective view of a dispenser for sheet material from the lower end of the dispenser, showing sheet material disposed in the dispenser (illustrated by phantom lines) and sheet material extending from an exit port.

Reference will now be made in detail to the presently preferred embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

Figure 2:
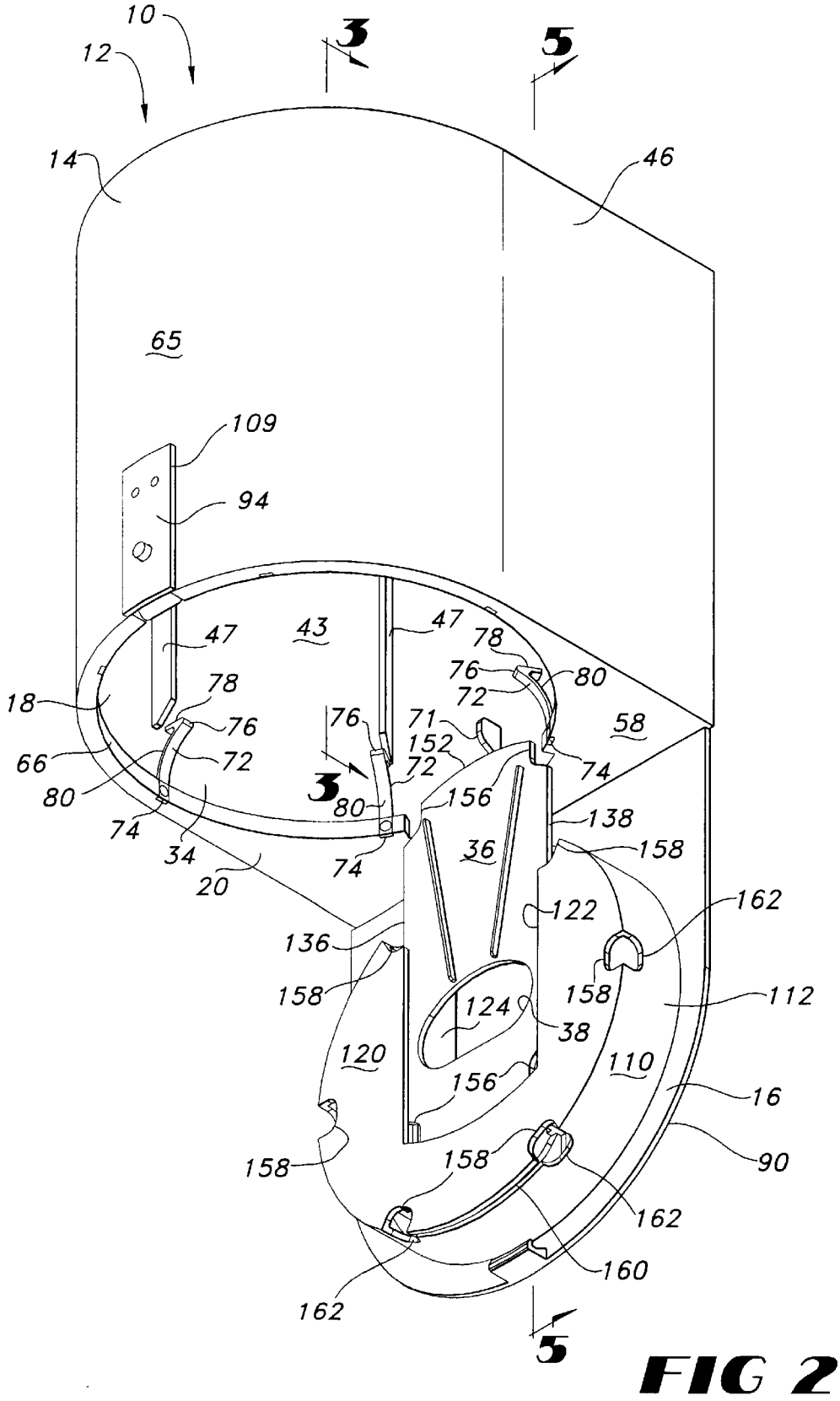
FIG. 2 is a perspective view of the dispenser of FIG. 1, showing the dispenser opened and a dispensing member supported by an access door.

Illustrated in FIGS. 1–11 is a dispenser 10 for dispensing sheet material. The dispenser 10 includes a dispenser housing 12. The dispenser housing 12 includes a roll housing 14 and an access door 16, as shown in FIGS. 1 and 2. The roll housing 14 is formed to include a roll opening 18 on a lower end 20 thereof. The access door 16 supports a dispensing member 24 which is positioned over the roll opening 18. It will be appreciated, however, that the dispensing member 24 may be provided separately from the dispenser housing 12.

The access door 16 is movably coupled to a portion 26 of the lower end 20 of the roll housing 12 via a hinge 28, as illustrated in FIGS. 1, 2 and 5–7. A fastener (not shown), however, or any mechanism may be used to couple the access door 16 to the roll housing 14. It will be understood that the dispensing member 24 controls dispensing of sheet material from the dispenser 10.

Figure 3:
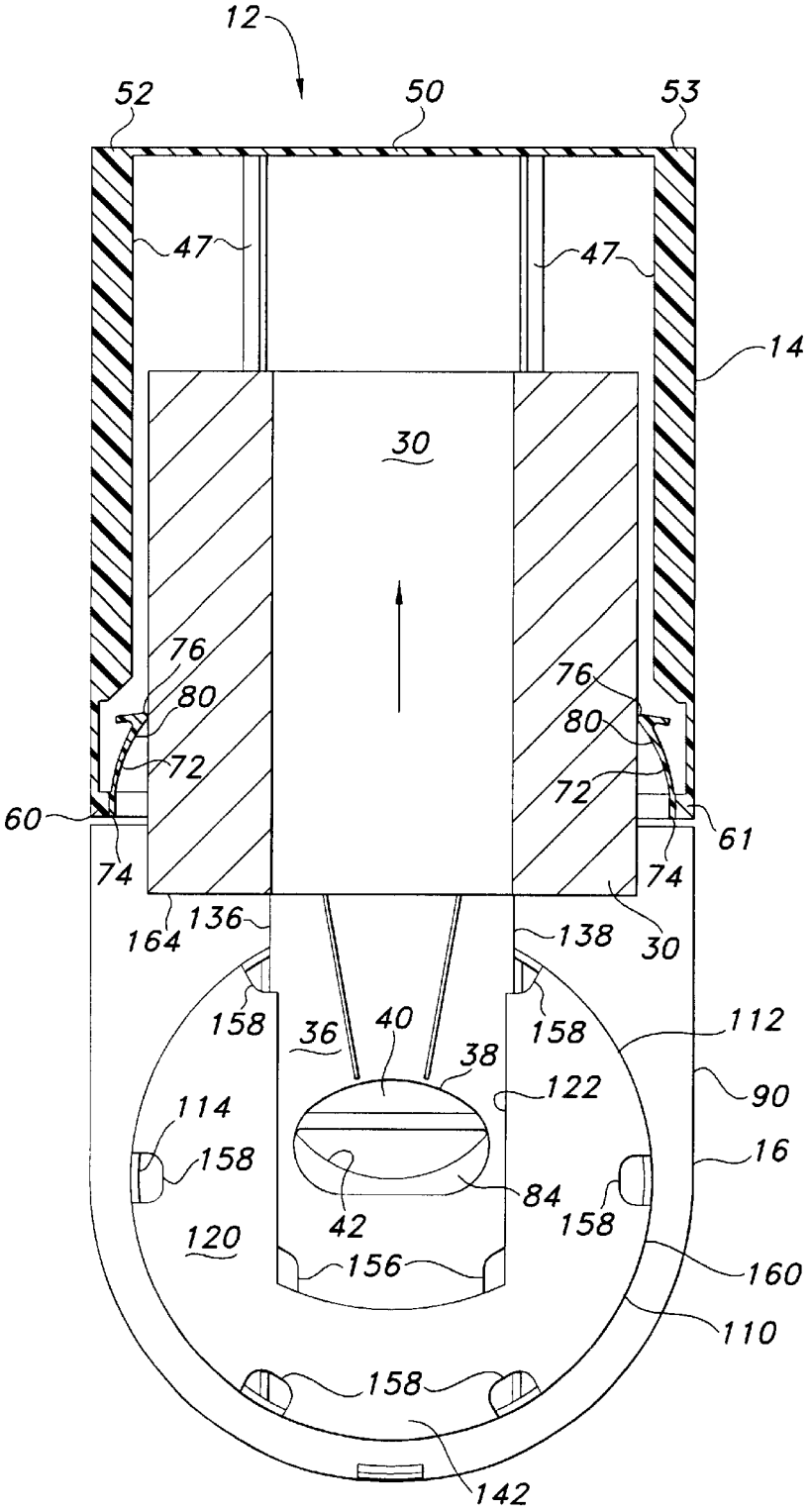
FIG. 3 is a sectional view of FIG. 2 taken along lines 3—3, showing loading of a centerflow roll in the dispenser.
Figure 4:
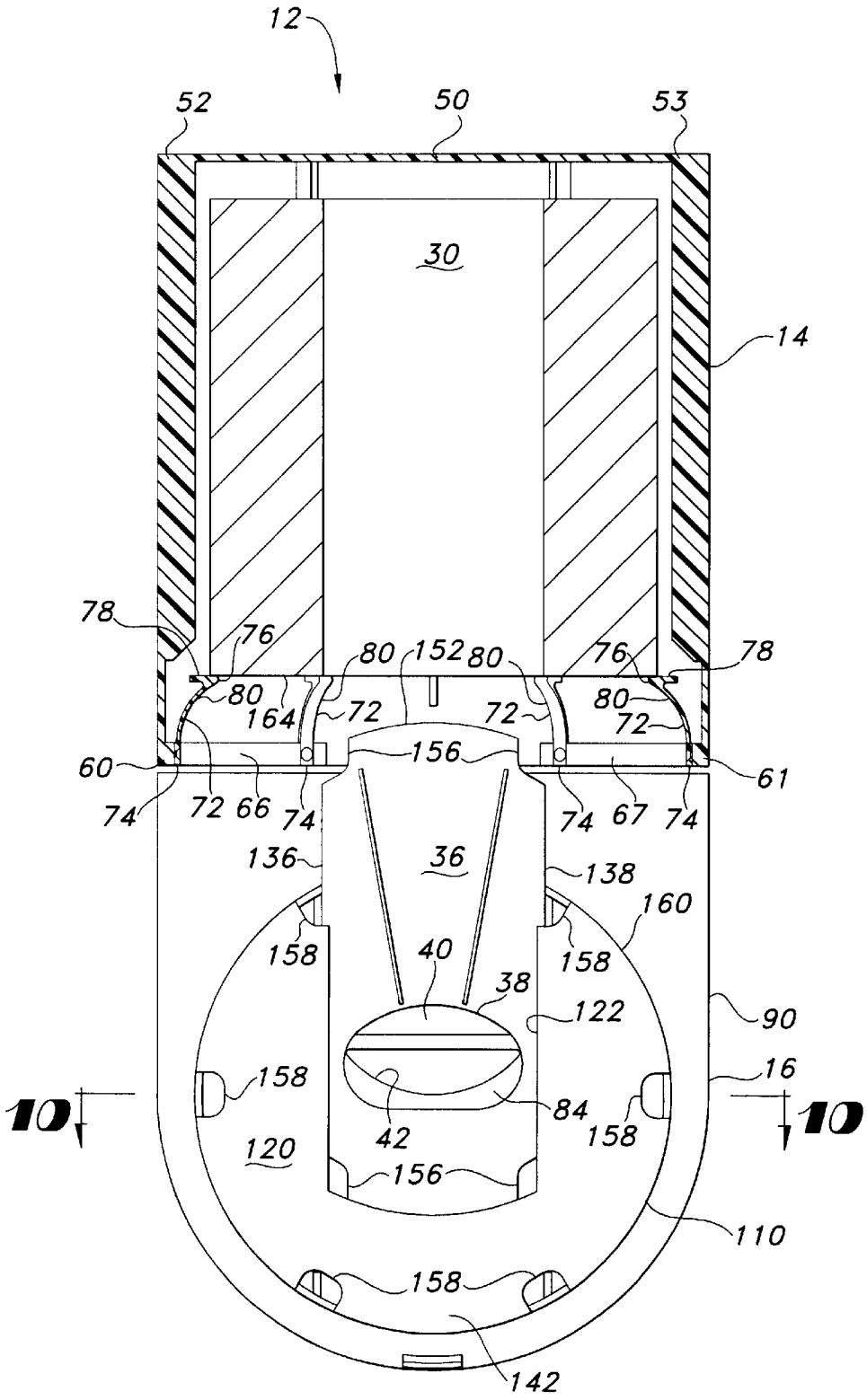
FIG. 4 is a sectional view similar to FIG. 3 showing a loaded position of a centerflow roll in the dispenser.

In the present embodiment, a centerflow roll 30 of sheet material 32 is disposed through the roll opening 18 and into a chamber 34 formed in the roll housing 14, as shown in FIGS. 1, 3 and 4. It will be appreciated, however, that stacked (not shown), accordion-folded (not shown), and so forth sheet material may be used in other embodiments.

The dispensing member 24 includes a movable first panel 36 formed to include an opening 38 formed therein which is spaced-apart from a second panel 40 having an exit port 42 provided therein, as illustrated in FIGS. 1, 2 and 5–7. When the access door 16 is opened and moved away from at least a portion of the opening 18 in the roll housing 14, the access door 16 and the dispensing member 24 are positioned in an opened loading position. That is, the access door 16 is moved so that the chamber 34 formed in the roll housing 14 is accessible for loading a centerflow roll 30 of sheet material 32 therein. In addition, at least a portion of the opening 38 of the first panel 36 of the dispensing member 24 is also moved into an alignment with the exit port 42 in the second panel 40, to facilitate threading of the newly loaded sheet material 32 through the opening 38 and the exit port 42. When the access door 16 is moved adjacent or against the opening 18 in the roll housing 14 to provide closure to the roll housing 14, the access door 16 and the dispensing member 24 are positioned in a closed dispensing position. Desirably, the opening 38 of the first panel 36 is moved out of axial alignment with the exit port 42 of the second panel 40, to facilitate dispensing of an effective amount of sheet material 32 from the dispenser 10, i.e., one sheet material at a time.

Turning now to the roll housing 14, as shown in FIGS. 1–8, which includes a cylindrical sidewall 43 mounted between a pair of spaced-apart sidewalls 44, 46. A plurality of spaced-apart positioning ribs 47 extend radially about the cylindrical sidewall 43, to generally assist, but not by way of limitation, in aligning the centerflow roll 30 for dispensing. The sidewalls 44, 46 are each coupled to a back plate 48. A top plate 50 is desirably coupled to or formed with an upper end 52, 53 of each sidewall 44, 46, an upper end 54 of the cylindrical sidewall 43, and an upper end 56 of the back plate 48. A partial lower plate 58 is desirably coupled to or formed with lower ends 60, 61, of each sidewall 44, 46, a lower end 62 of the cylindrical sidewall 43, and a lower end 64 of the back plate 48, as illustrated best in FIGS. 2–4. The roll housing 14 is positioned generally on a front 65 of the dispenser 10. It will be understood that the orientation of the roll housing 14 and the access door 16 may vary in different embodiments. The dispenser housing 12 or any portion thereof, i.e., the roll housing 14 and/or the access door 16, is not intended as a limiting feature of the invention and may take on any shape or configuration. In addition, the dispenser housing 12 may be made of any suitable material(s).

At least a portion of the roll housing 14 and/or the top plate 50 may be formed from an opaque material, or alternatively, the roll housing 14 and/or the top plate 50, or any portions of the dispenser 10, may be formed from a clear, tinted, or translucent material, so that a reduction in the centerflow roll 30 disposed in the dispenser 10 can be seen by an operator. It will be appreciated that in the present embodiment the roll housing 14 is cylindrical to follow the curvature of the centerflow roll 30 of sheet material 32 positioned therein. Other shapes of the roll housing and/or the access door may be used in other embodiments to accommodate different configurations of sheet materials.

The lower end 62 of the cylindrical sidewall 43 of the roll housing 14 includes flange members 66, 67 which are each positioned about an inner surface 68 of the cylindrical sidewall 43 and cooperate to extend radially substantially around the lower end 62 except for a back portion 69 of the lower end 62 positioned nearest to the back plate 48 and a front portion 70 which is positioned generally opposite the back portion 69, as illustrated in FIGS. 2 and 4.

A vertical control rib 71 is positioned generally adjacent the back portion 69 and the lower end 62 of the cylindrical sidewall 43, as shown in FIGS. 2 and 5–7, and will be discussed in detail below.

A plurality of spaced-apart resilient spring fingers 72 are provided in the roll housing 14, as illustrated in FIGS. 2–4 and 11, to support the newly loaded centerflow roll 30 while sheet material 32 is being threaded through the dispensing member 24 by an operator. Each resilient spring finger 72 is coupled at one end 74 to the flange member 68, and at an opposite end 76 has a flat support surface 78 for supporting the centerflow roll 30 thereupon. Each resilient spring finger 72 has a curved body 80 positioned between ends 74 and 76 which extends radially at an oblique angle upwardly and inwardly towards the center of the chamber 34 of the roll housing 14. The plurality of resilient spring fingers 72 cooperate to provide a diameter generally smaller than the diameter of a standard centerflow roll 30 of sheet material 32.

Figure 11:
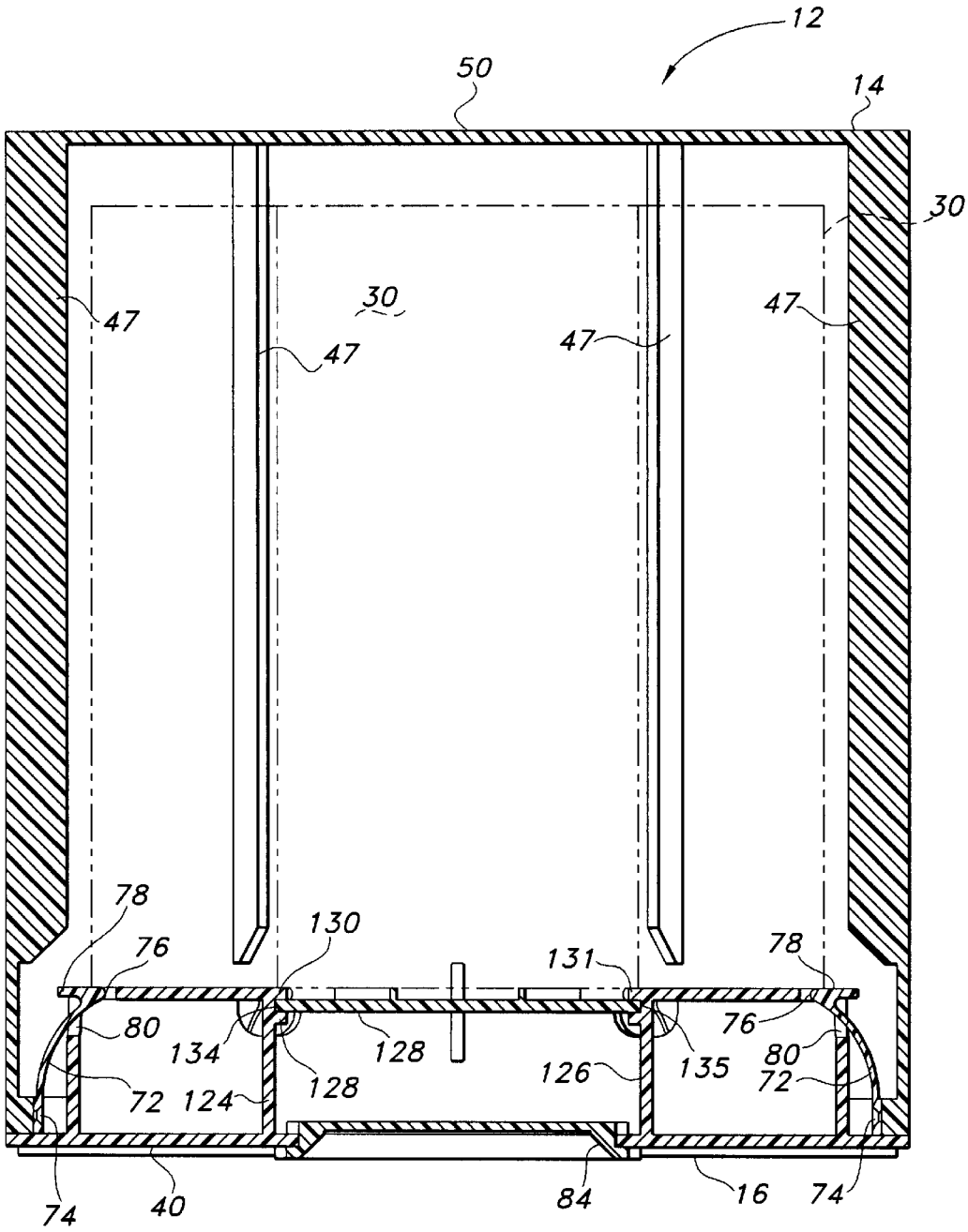
FIG. 11 is a sectional view similar to FIG. 4, but showing the access door and the dispensing member in a closed position.

The spring fingers 72 are formed from a resilient material, such as, by way of non-limiting example, metal, plastic, and so forth, which permit the spring fingers 72 to deflect toward the cylindrical sidewall 43 of the roll housing 14 when there is pressure from a centerflow roll 30 thereagainst, to permit a centerflow roll 30 of sheet material 32 to pass thereby, as shown in FIG. 3. The spring fingers 72 resiliently move back into their original position once the centerflow roll 30 is positioned above and supported on the spring fingers 72 (FIGS. 4–7), and the pressure from the passage of the centerflow roll 30 is removed therefrom. The flat support surface 78 of each of the spring fingers 72 then cooperates to support the centerflow roll 30 within the chamber 34 of the roll housing 14, while the access door 16 is opened for loading (FIG. 11). The resilient spring fingers may comprise and configuration(s), so long as the spring fingers operate generally as shown and described herein.

The access door 16 includes the dispensing member 24, which is generally centered on an upper surface 82 of the access door 16, and is positioned adjacent the chamber 34 of the roll housing 14, as shown in FIGS. 2–4. The access door 16 in the present embodiment provides the second panel 40, illustrated best in FIGS. 1, 3–8, and 11, for the dispensing member 24, defined generally in the present embodiment by the access door 16. It will be understood that the second panel 40 and the dispensing member 24 may be formed separately and coupled to the access door 16 or similar structure (not shown). The exit port 42 in the present embodiment is provided in an exit port plate 84 which is supported by the second panel 40 as shown in FIGS. 1, 3–7, and 11. It will be appreciated that the access door 16 may be formed substantially from one panel which includes the exit port 42 (not shown).

A perimeter 90 of the access door 16 generally follows the shape of the lower end 20 of the roll housing 14 (FIGS. 2 and 7), and the shape facilitates closing and securing the access door 16 against the roll housing 14. The access door 16 and the roll housing 14 include a closure/locking mechanism 94, and one closure/locking mechanism 94 is provided by way of non-limiting example, to show one method of providing a closure for the access door 16 against the roll housing 14, as illustrated in FIGS. 2, 6–7, 9A and 9B.

The closure/locking mechanism 94 includes a coupling flange 96 which is positioned on the upper surface 82 adjacent a front end 97 of the perimeter 90 of the access door 16. The coupling flange 96 includes at one end a retention lip 98. As shown best by FIGS. 9A and 9B, the closure/locking mechanism 94 also includes a button panel 100 which is coupled at one end by a pair of fasteners 102 to the inner surface 68 of the cylindrical sidewall 43 of the roll housing 14 in the front portion 70. The opposite end of the button panel 100 is formed to provide a locking tab 106. A button 108 is coupled to one side of the button panel 100 and extends through an aperture in the cylindrical sidewall 43 and an aperture in the front button plate 109 on the front 65 of the roll housing 14. The locking tab 106 is positioned such that when the retention lip 98 moves past the locking tab 106, the locking tab 106 engages the retention lip 98 to hold and retain the access door 16 in a closed position against the lower end 20 of the roll housing 14. When the button 108 is depressed, the locking tab 106 is moved away from and disengages the retention lip 98, permitting the access door 16 to move away from the lower end 20 of the roll housing 14. It will be understood that the closure/locking mechanism 94 may include a locking mechanism (not shown). By way of non-limiting example, to provide a locking mechanism, the button is recessed and includes a key receptacle, and the locking tab is pivotally coupled to the button and button panel (not shown). When a key is disposed in the key receptacle of the button and turned, the locking tab is pivotally moved away from the retention lip 98, unlocking the access door 16 from the roll housing 14. It will be appreciated that the closure/locking mechanism or any portion thereof is not a limiting feature of the invention, and any closure/locking mechanism which operates generally to close/lock the dispenser may be used.

Figure 10:
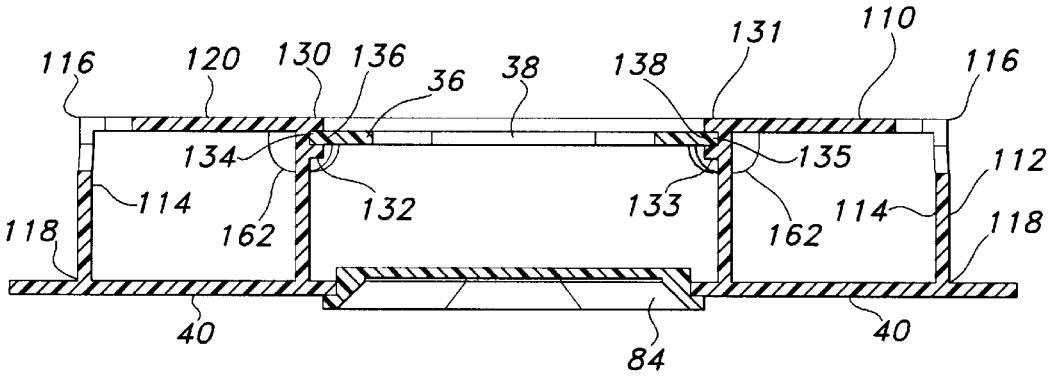
FIG. 10 is a sectional view of the access door and the dispensing member of FIG. 4 taken along lines 10—10.

The dispensing member 24, as shown in FIGS. 2–8, 10 and 11, includes a cylindrical base 110 having a cylindrical perimeter sidewall 112 which has an inner side 114 and opposite perimeter edges 116, 118. A partial top panel 120 is provided and is coupled to a portion of the perimeter edge 116. The partial top panel 120 includes a panel slot 122 formed therein. Spaced-apart and parallel ribs 124, 126 are coupled to a portion of the top panel 120 on a lower surface 128 thereof, adjacent each side of the panel slot 122 at approximately a 90 degree angle, as shown in FIGS. 10 and 11. Each rib 124, 126 extends transversely from one inner side 114 of the sidewall 112 across to the other, and from one perimeter edge 116 to the opposite perimeter edge 118. Portions 130, 131 of the top panel 120 extend beyond each rib 124, 126 in a confronting relationship. Each rib 124, 126 includes a flange 132, 133, respectively, each of which is positioned in a confronting relationship relative to the other. Grooves 134, 135 are defined between portion 130 and flange 132, and portion 131 and flange 133, respectively. The first panel 36 is positioned so that its perimeter sides 136, 138 slide in grooves 134, 135, respectively, and a front end 140 of the first panel 36 slides below a front portion 142 of the top panel 120, as shown in FIGS. 5–7, 10 and 11.

Figure 5:
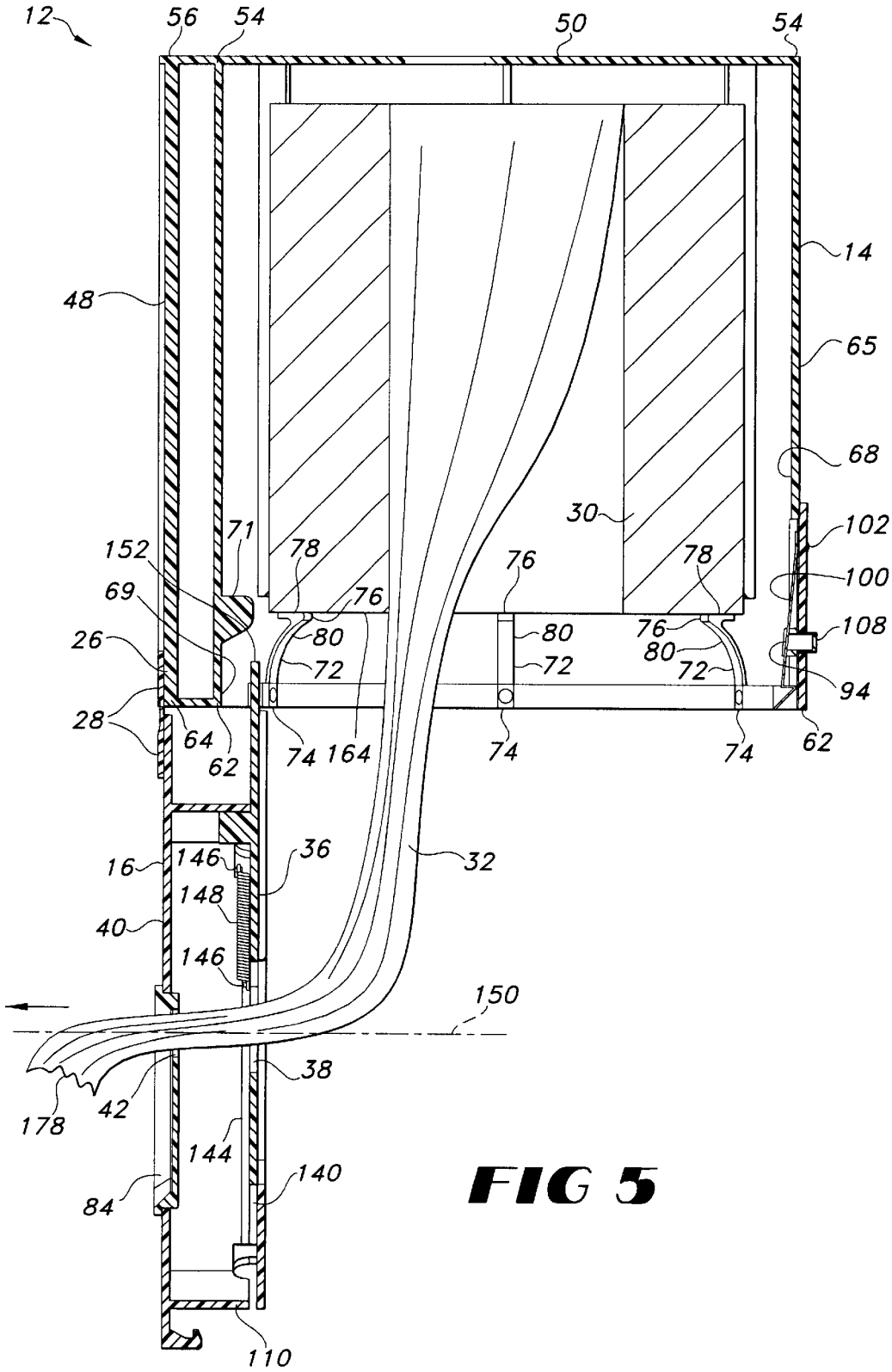
FIG. 5 is a sectional view of FIG. 2 taken along lines 5—5, showing the centerflow roll loaded and the sheet material threaded through the dispensing member on the access door, the dispensing member and access door positioned in a loading position.
Figure 6:
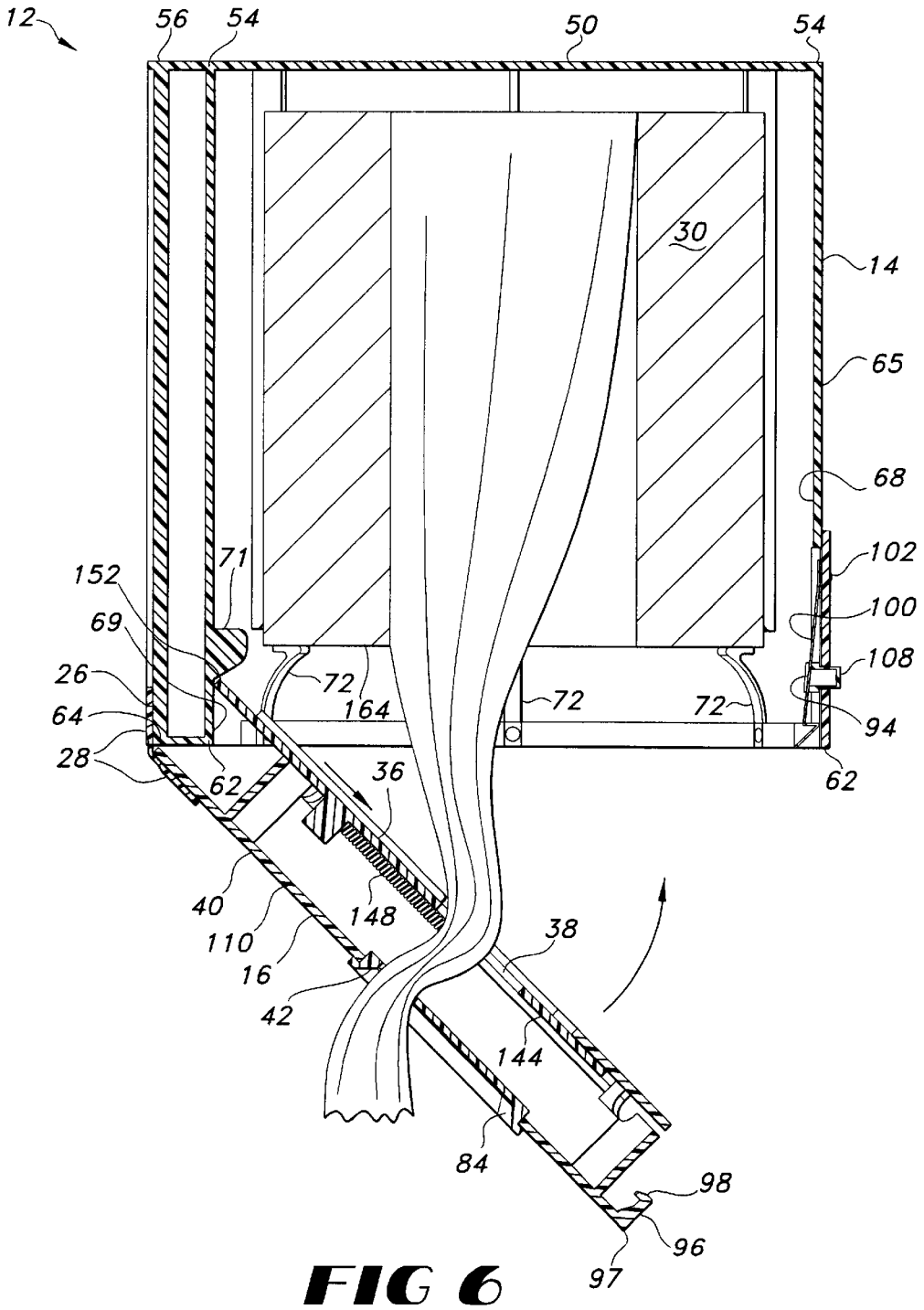
FIG. 6 is a sectional view similar to FIG. 5, showing a partial closure of the access door and the movement of at least one panel of the dispensing member.
Figure 7:
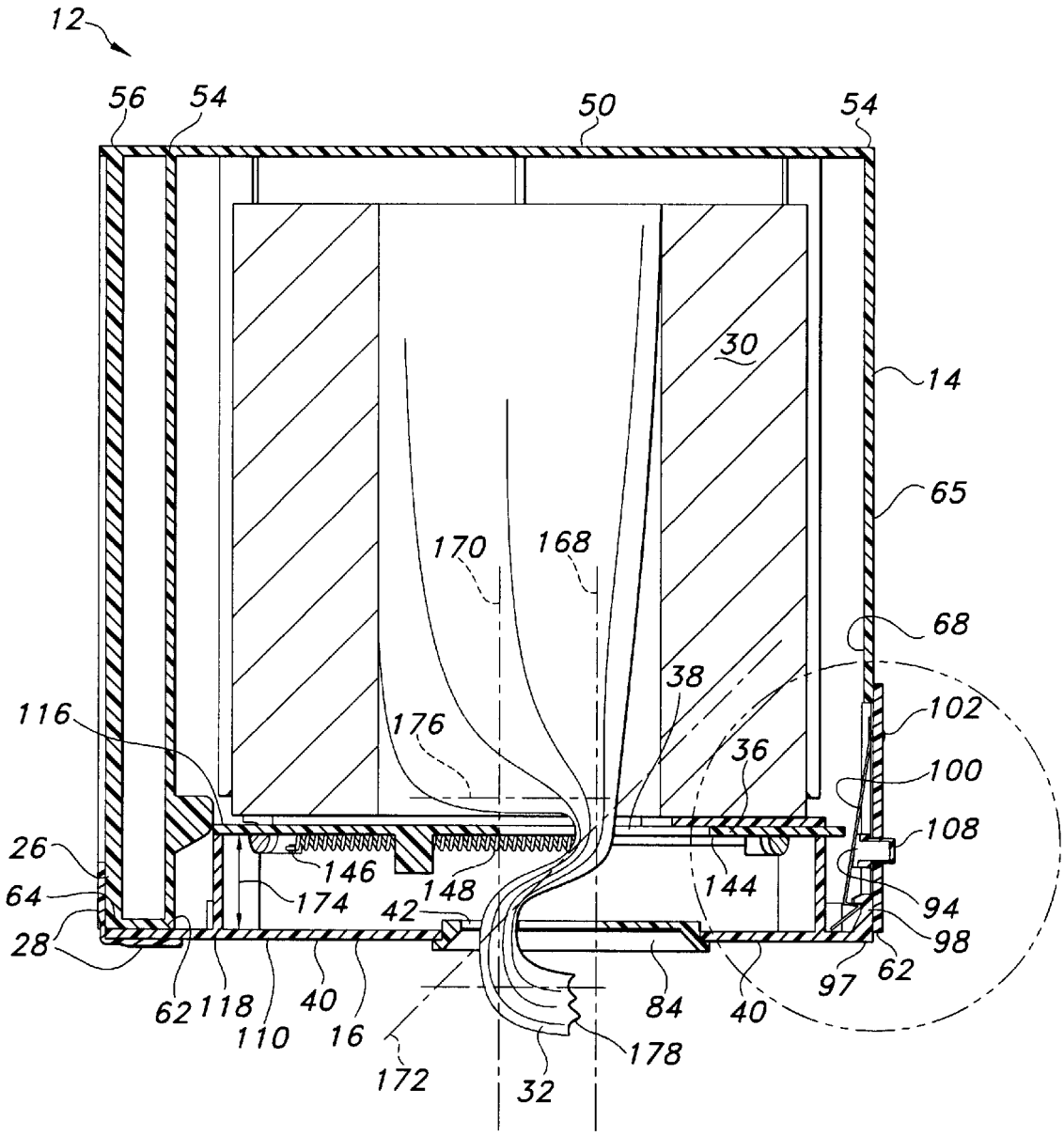
FIG. 7 is a sectional view similar to FIG. 5, showing the access door and the dispensing member in a closed dispensing position with a leading edge of sheet material extending from an exit port.
Figure 8:
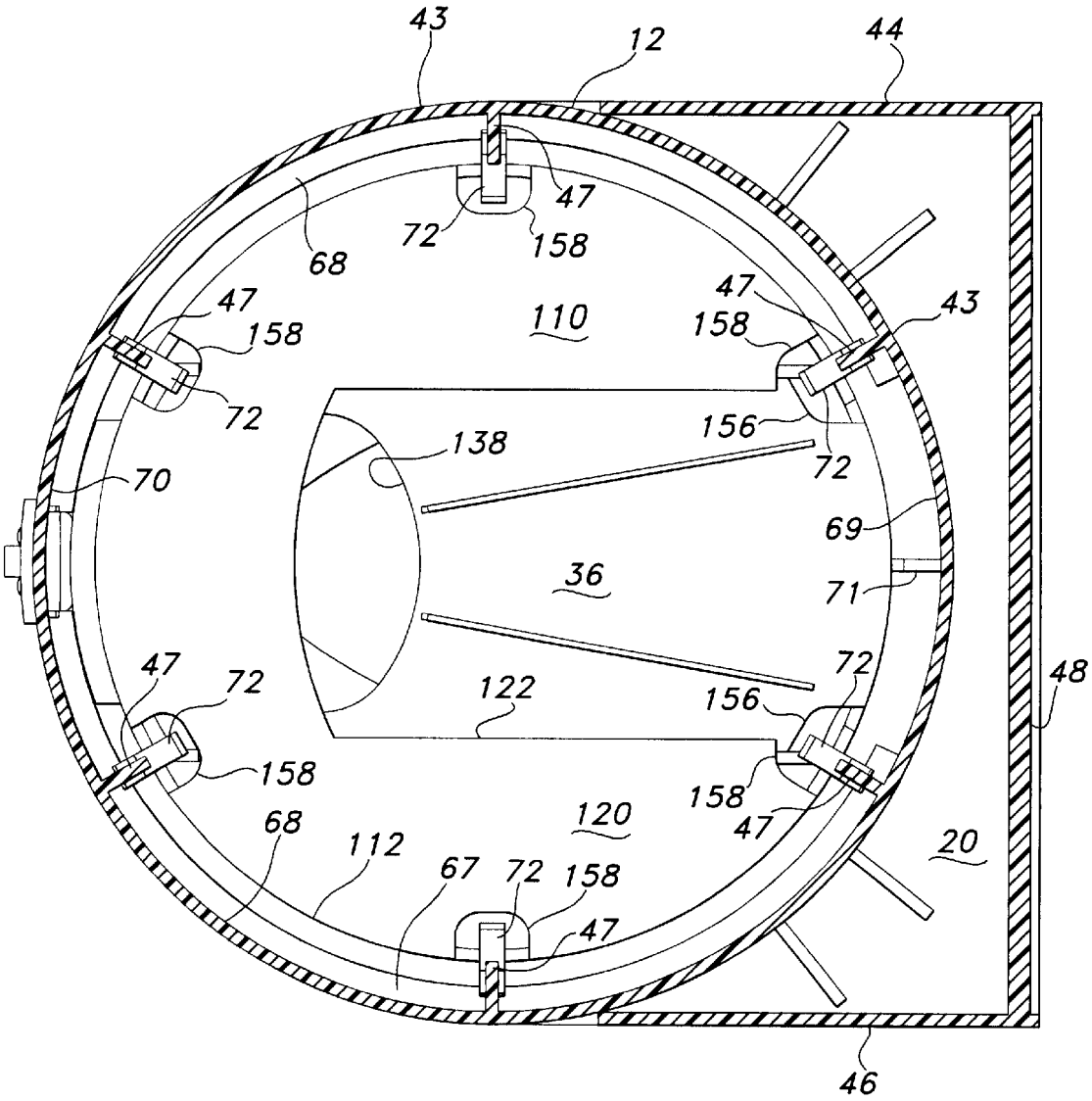
FIG. 8 is a sectional view of FIG. 1 taken along lines 8—8.

The first panel 36 is spaced-apart from the second panel 40 provided as part of the access door 16 via the ribs 124, 126, which cooperate to hold the first panel 36 in position(s), as illustrated in FIGS. 5–7, 10 and 11. A lower surface 144 near the perimeter side 136 of the first panel 36 includes a fastener 146 having one end of a spring 148 coupled thereto. Another fastener 146 couples an opposite end of the spring 148 to the base 110. When the access door 16 is opened in a loading position, the spring 148 contracts to move the first panel 36 such that at least a portion of the opening 38 therein is in a generally horizontal axial alignment along axis 150 with the exit port 42 in the second panel 40, as shown in FIGS. 3–5. A back end 152 of the first panel 36 is positioned by the contraction of the spring 148 against the vertical control rib 71, which assists in holding the first panel 36 in the loading position. When the access door 16 is closed against the lower end 20 of the roll housing 14 in a dispensing position, the back end 152 of the first panel 36 is pressed against the vertical control rib 71, causing the first panel 36 to be positioned thereagainst, moving the first panel 36 out of axial alignment with the exit port 42 and causing the spring 148 to expand when the access door 16 is closed in the dispensing position, as illustrated in FIG. 7.

The first panel 36 includes a plurality of clearance slots 156 positioned at the junction of side 136 and front end 140, side 138 and front end 140, side 136 and back end 154, and side 138 and back end 154, as illustrated in FIGS. 2 and 7. The slots 156 correspond to and cooperate with a plurality of clearance slots 158 formed in a perimeter edge 160 of the partial top panel 120, which similarly correspond and cooperate with a plurality of clearance slots 162 formed in the perimeter edge 116 of the base 110. Each of the plurality of clearance slots 156, 158, 162 align and cooperate with the position of each of the plurality of resilient spring fingers 72 positioned in the roll housing 14, as shown in FIG. 11 to permit the dispensing member 24 to move adjacent to the spring fingers 72 when the access door 16 is closed without interfering with the spring fingers 72. Such cooperation permits the dispensing member 24 supported by the access door 16 to be positioned in the roll housing 14 so that a lower end 164 of a centerflow roll 30 of sheet material 32 rests generally upon the top panel 120 of the dispensing member 24, thereby removing the substantial amount of the weight of the centerflow roll 30 from the resilient spring fingers 72 and transferring the weight to the top panel 120. When the access door 16 is closed against the lower end 20 of the roll housing 14, the first panel 36 is moved by the control rib 71 into a dispensing position and the clearance slots 156, 158 and 162 are moved into a cooperative alignment.

In this manner, the resilient spring fingers 72 are used primarily to support, desirably temporarily, the centerflow roll 30 when it is loaded in the roll housing 14, as shown in FIG. 4. This permits an operator, during loading, to have both hands free, to easily thread the sheet material 32 through the dispensing member 24 without holding the centerflow roll 30 at the same time. The resilient spring fingers 72 are desirably not required to support the weight of the centerflow roll 30 for dispensing, as illustrated in FIG. 11. Alternatively, however, it will be appreciated that the plurality of resilient spring fingers 72 may be used to permanently support the centerflow roll 30.

In the present embodiment, the opening 38 in the first panel 36 is formed to have at least a generally semi-circular or semi-elliptical shape, with the concave curvature of the semi-circular or semi-elliptical opening 38 being positioned toward the back plate 48 of the dispenser housing 12 as shown in FIG. 2–4. Similarly, the exit port 42 formed in the exit port plate 84 of the second panel 40 is also formed to be semi-circular or semi-elliptical, and the concave curvature of the semi-circular or semi-elliptical shape is positioned toward the front 65 of the dispenser housing 12. It will be understood that the size and configuration of the opening 38 and the exit port 42 may be any shape or combination of shapes and sizes.

It will be appreciated that the second panel 40 may be provided as a movable panel, while the first panel 36 is provided as a stationary panel (not shown). In another alternative, both the first panel 36 and the second panel 40 may be movable (not shown). Any alternative may be used in the present invention, so long as the invention operates to provide the advantages as generally described and illustrated herein.

When the access door 16 and therefore the dispensing member 24 are positioned in an opened loading position, as illustrated in FIGS. 2–5, at least a portion of the opening 38 in the first panel 36 and the exit port 42 of the second panel 40 are in an axial alignment (FIG. 5). Axis 150 extends generally horizontally through at least a portion of the aligned opening 38 and exit port 42, to facilitate threading sheet material 32 from a newly loaded centerflow roll 30 therethrough, as shown in FIG. 5. When the access door 16 and the dispensing member 24 are positioned in a closed dispensing position, the opening 38 is moved out of alignment with the exit port 42, such that the opening 38 is positioned on one or a first axis 168 which extends generally, but not by way of limitation, vertically through the opening 38 when the access door 16 is in a closed position, and the exit port 42 is positioned on a separate or a second axis 170 spaced-apart and generally parallel to axis 168. An oblique or third axis 172 extends through both opening 38 and exit port 42, intersecting the first axis 168 and the second axis 170. In addition, the first panel 36 is spaced-apart generally vertically a distance 174 from the second panel 40.

In a dispensing position, as illustrated best in FIGS. 1 and 7, the sheet material 32 is positioned against the concave curvature of the opening 38 in the first panel 36 and the concave curvature of the exit port 42 of the second panel 40, following a generally circuitous path 176, for example, Z-shaped, S-shaped, serpentine, and so forth, as it flows from the roll housing 12 and through the opening 38 and the exit port 42 of the first and second panels 36, 40. The spatial positioning of the opening 38, the distance 174, and the exit port 42 in the dispensing position result in a frictional resistance of the sheet material 32 as it flows along the circuitous path 176. It will be appreciated that the frictional resistance is also created by the selection of the size and configuration of the opening 38 and the exit port 42. These elements in combination cooperate to provide dispensing of an effective amount of sheet material, i.e., desirably, one sheet material at a time, thereby avoiding excessive dispensing or under dispensing of sheet material.

Figure 9A:
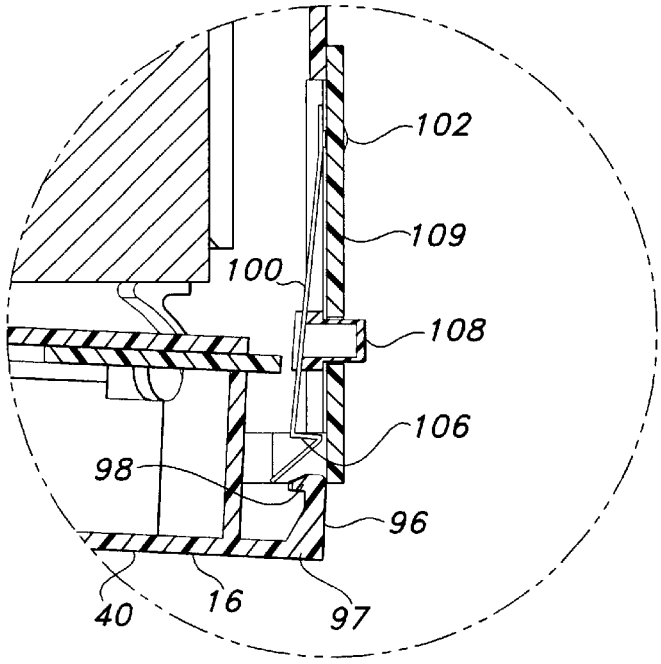
FIG. 9A is a partial sectional view taken from FIG. 7 showing the closure/locking mechanism in an open and unlocked position.
Figure 9B:
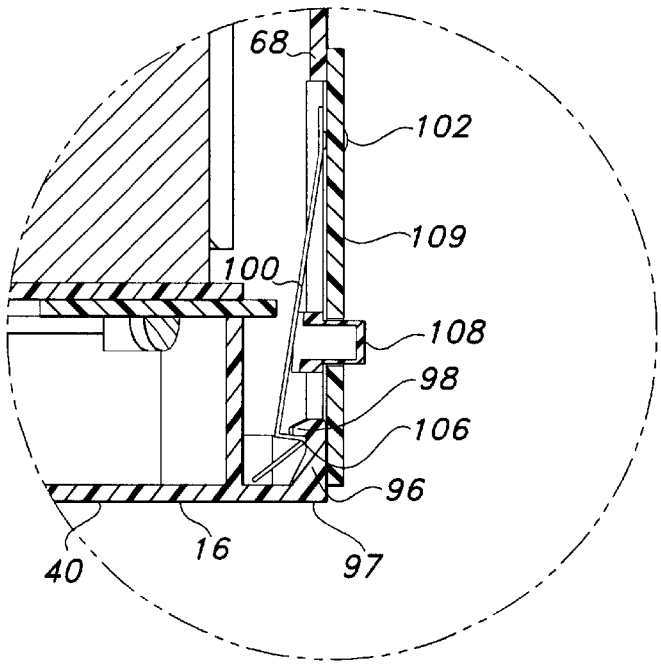
FIG. 9B is a partial sectional view taken from FIG. 7, showing only the closure/locking mechanism in a closed/locked position.

A method of installing sheet material 32 in a dispenser 10 is shown and described in detail herein. The roll housing 14 of the dispenser 10 is opened by an operator by pushing the button 108 of the closure mechanism 94, which moves the locking tab 106 away from the retention lip 98 (FIGS. 9A and 9B), thereby permitting the access door 16 to move away from at least a portion of the roll housing 14 and into an opened loading position. This positioning of the access door 16 relative to the roll housing 14 permits an operator to access the storage chamber 34, as illustrated in FIGS. 2–6. The movement of the access door 16 permits movement of the first panel 36 of the dispensing member 24 via the retraction of the spring 148 coupled to both the first panel 36 and the base 110, thereby moving the first panel 36 and at least a portion of the opening 38 therein into an axial alignment with at least a portion of the exit port 42 in the second panel 40, as shown in FIGS. 3–5. A centerflow roll 30 of sheet material 32 is positioned in the chamber 34 by pushing the centerflow roll 30 against the plurality of resilient spring fingers 72, the pressure of the centerflow roll 30 deflecting the spring fingers 72 toward the cylindrical sidewall 43 of the roll housing 14, until the centerflow roll 30 is positioned above the spring fingers 72, as illustrated in FIGS. 3, 4 and 11. The spring fingers 72 return to their original un-deflected position to cooperate to support the weight of the centerflow roll 32 upon the flat support surface 78 of each spring finger 72. A leading edge 178 of the sheet material 32 in the centerflow roll 30 is threaded through the dispensing member 24 via the generally axially aligned opening 38 of the first panel 36 and the exit port 42 of the second panel 40 for loading. The access door 16 is then moved back against the lower end 20 of the roll housing 14. The retention lip 98 is moved past the locking tab 106, permitting the access door 16 to be positioned and retained against the lower end 20 of the roll housing 14, as shown in FIGS. 7, 9A and 9B. In addition, the movement of the access door 16 moves the back end 152 of the movable first panel 36 against the vertical retention rib 71, thereby moving the first panel 36 and the clearance slots 156 therein into an alignment to cooperate with the clearance slots 158, 164 of the top panel 120 and the base 110, respectively, so that the top panel 120 of the dispensing member 24 is disposed against and holds the lower end 164 of the centerflow roll 30, thereby substantially supporting the weight of the centerflow roll 30, as illustrated in FIG. 11. The movement of the access door 16 and the moveable first panel 36 of the dispensing member 24 also moves the opening 38 in the first panel 36 out of axial alignment with the exit port 42 of the second panel 40, positioning the opening 36 on one or the first axis 168 and the exit port 38 on another or the second axis 170. The first axis 168 and the second axis 170 are desirably, but not by way of limitation, generally parallel, and the sheet of material 32 flows through the opening 38 and the exit port 42 on a third axis 172, along the circuitous path 176.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser for dispensing sheet material, comprising:

a housing having a chamber configured to hold sheet material, the housing including an access door configured to provide both access to the chamber and closure to the chamber; and a dispensing member supported by the access door, the dispensing member including a first panel having an opening therein which is spaced-apart from a second panel having an exit port provided therein, at least one panel being movable such that when the access door is positioned in an opened loading position to permit sheet material to be loaded into the chamber, at least one of the panels moves so that a portion of the opening in the first panel and a portion of the exit port in the second panel are moved into an axial alignment to permit sheet material to be readily threaded therethrough, and when the access door is positioned in a closed dispensing position, at least one of the panels moves so that the opening in the first panel and the exit port in the second panel are moved out of axial alignment so that the sheet material in the chamber flows through the non-aligned opening and exit port.

2. The dispenser of claim 1, wherein the first panel having an opening formed therein is configured to move so that the opening is positioned in axial alignment with the exit port of the second panel when the access door is opened.

3. The dispenser of claim 1, wherein the first panel having an opening formed therein is configured to move so that the opening is positioned out of axial alignment relative to the exit port of the second panel when the access door is closed.

4. The dispenser of claim 3, wherein the opening of the first panel is positioned on a first axis and the exit port of the second panel is positioned on a second axis.

5. The dispenser of claim 4, wherein the sheet material flows from the opening of the first panel to the exit port of the second panel on a third axis.

6. The dispenser of claim 1, wherein sheet material disposed in the chamber of the housing flows therefrom through the opening and out of the exit port in a circuitous path to facilitate an amount of frictional resistance.

7. The dispenser of claim 1, wherein the access door is movably coupled to the housing.

8. The dispenser of claim 1, wherein a plurality of spaced-apart resilient spring fingers are positioned in the chamber of the housing and cooperate to support sheet material positioned therein.

9. The dispenser of claim 8, wherein each resilient spring finger is configured to move away from pressure thereagainst to permit sheet material to move by each resilient spring finger, each resilient spring finger being configured to return to its original position relative to the housing when the pressure is removed therefrom to support the sheet material lying thereon.

10. A dispenser for dispensing sheet material, comprising:

a housing having a chamber configured to hold sheet material, the housing including an access door configured to provide both access to the chamber and closure to the chamber; and a dispensing member supported by the access door, the dispensing member including a movable first panel having an opening therein which is spaced-apart from a second panel having an exit port provided therein such that when the access door is positioned in an opened loading position to permit sheet material to be loaded into the chamber, the first panel moves so that a portion of the opening therein is moved into an axial alignment with a portion of the exit port in the second panel to permit sheet material to be readily threaded therethrough, and when the access door is positioned in a closed dispensing position, the first panel moves so that the opening therein is moved out of axial alignment with the exit port in the second panel so that sheet material in the chamber flows through the non-aligned opening and exit port.

11. The dispenser of claim 10, wherein when the access door is positioned in the closed dispensing position the opening in the first panel is positioned on a first axis and the exit port in the second panel is positioned on a second axis.

12. The dispenser of claim 11, wherein the first axis and second axis are parallel.

13. The dispenser of claim 11, wherein the sheet material positioned between the opening and the exit port flows therebetween on a third axis.

14. The dispenser of claim 11, wherein the first panel is spring biased for movement.

15. The dispenser of claim 14, wherein the first panel of the dispensing member is spring biased to move the opening formed therein into an alignment with the exit port of the second panel when the access door opened and to move the opening formed therein out of axial alignment with the exit port of the second panel when the access door is closed.

16. The dispenser of claim 10, wherein the sheet material disposed in the chamber of the housing flows therefrom through the opening and out of the exit port on a circuitous path configured to facilitate an amount of frictional resistance.

17. The dispenser of claim 10, wherein the access door is movably coupled to the housing.

18. The dispenser of claim 10, wherein the housing includes a plurality of spaced-apart resilient spring fingers which cooperate to support sheet material therein.

19. The dispenser of claim 18, wherein each resilient spring finger is configured to move away from pressure thereagainst to permit sheet material to be disposed in the dispenser, each resilient spring finger configured to return to its original position relative to the housing when the pressure is removed therefrom to support sheet material lying therein.

20. An apparatus for use with a dispenser housing having a chamber configured to hold sheet material, the dispenser housing adapted to have an access door configured to provide both access to the chamber and closure to the chamber, the apparatus configured to cooperate with an access door to provide dispensing of sheet material therethrough, the apparatus comprising:

a dispensing member supported by and including an access door, the dispensing member including a first panel having an opening therein which is spaced-apart from a second panel having an exit port provided therein, at least one panel being moveable such that when the access door is positioned in an opened loading position to permit sheet material to be loaded into the chamber, at least one of the panels moves so that a portion of the opening in the first panel and a portion of the exit port in the second panel are moved into an axial alignment to permit sheet material to be readily threaded therethrough, and when the access door is positioned in a closed, dispensing position, at least one of the panels moves so that the opening in the first panel and the exit port in the second panel are moved out of axial alignment so that the sheet material in the chamber flows through the non-aligned opening and exit port.

21. The apparatus of claim 20, wherein the first panel having an opening formed therein is configured to move so that the opening is positioned in axial alignment with the exit port of the second panel when the access door is opened.

22. The apparatus of claim 20, wherein the first panel having an opening formed therein is configured to move so that the opening is positioned out of axial alignment relative to the exit port of the second panel when the access door is closed.

23. The apparatus of claim 22, wherein the opening in the first panel is positioned on a first axis and the exit port of the second panel is positioned on a second axis.

24. The apparatus of claim 23, wherein the first axis and second axis are parallel.

25. The apparatus of claim 20, wherein the sheet material disposed in the chamber of the dispenser housing flows therefrom through the opening and out of the exit port in a circuitous path to facilitate an amount of frictional resistance.

26. A dispenser adapted to dispense sheet material, the dispenser comprising:

a housing having a chamber configured to hold sheet material, the housing including an access door configured to provide both access to the chamber and closure to the chamber; and controlling means supported by the access door for controlling the movement of sheet material from the housing through an exit port, the controlling means including a first panel having an opening therein which is spaced-apart from a second panel having the exit port provided therein, at least one panel being movable such that when the access door is positioned in an opened loading position to permit sheet material to be loaded into the chamber, at least one of the panels moves so that a portion of the opening in the first panel and a portion of the exit port in the second panel are moved into an axial alignment to permit sheet material to be readily threaded therethrough, and when the access door is positioned in a closed dispensing position, at least one of the panels moves so that the opening in the first panel and the exit port in the second panel are moved out of axial alignment so that the sheet material in the chamber flows through the non-aligned opening and exit port.

27. The dispenser of claim 26, wherein the controlling means includes a dispensing member.

28. The dispenser of claim 26, wherein the first panel having an opening formed therein is configured to move so that the opening is positioned in axial alignment with the exit port of the second panel when the access door is opened.

29. The dispenser of claim 26, wherein the first panel having an opening formed therein is configured to move so that the opening is positioned out of axial alignment relative to the exit port of the second panel when the access door is closed.

30. The dispenser of claim 29, wherein the opening of the first panel is positioned on a first axis and the exit port of the second panel is positioned on a second axis.

31. The dispenser of claim 30, wherein the sheet material flows from the opening of the first panel to the exit port of the second panel on a third axis.

32. The dispenser of claim 26, wherein sheet material disposed in the chamber of the housing flows therefrom through the opening and out of the exit port in a circuitous path to facilitate an amount of frictional resistance.

33. The dispenser of claim 26, wherein the access door is movably coupled to the housing.

34. The dispenser of claim 26, wherein the housing includes a plurality of spaced-apart resilient spring fingers which cooperate to support sheet material therein.

35. The dispenser of claim 34, wherein each resilient spring finger is configured to move away from pressure thereagainst to permit sheet material to be disposed in the dispenser, each resilient spring finger configured to return to its original position relative to the housing when the pressure is removed therefrom to support the sheet material lying therein.

* * * * *